US005906448A

United States Patent [19]

Najmi

[11] Patent Number: 5,906,448

[45] Date of Patent: May 25, 1999

[54] CLIPBOARD WITH HOLE PUNCH

[76] Inventor: Boman K. Najmi, 2431 Crofton La. #9, Crofton, Md. 21114

[21] Appl. No.: 08/902,739

[22] Filed: Jul. 30, 1997

[51] Int. Cl.[6] ..... B42F 13/40

[52] U.S. Cl. ..... 402/1; 402/4; 281/45

[58] Field of Search ..... 402/1, 4, 80 R; 281/45; 83/620, 145, 167

[56] References Cited

U.S. PATENT DOCUMENTS

| | | | |
|---|---|---|---|
| 4,640,451 | 2/1987 | Steiner et al. | 402/1 X |
| 5,116,012 | 5/1992 | Offenhauer et al. | 281/45 X |
| 5,273,370 | 12/1993 | Bland et al. | 402/1 |
| 5,340,229 | 8/1994 | Schwartzman | 402/1 |
| 5,429,445 | 7/1995 | Un-Tae | 402/1 |
| 5,553,958 | 9/1996 | Bedol | 402/1 |

*Primary Examiner*—Frances Han
*Attorney, Agent, or Firm*—Frank A. Lukasik

[57] ABSTRACT

A combination of a paper holder and a paper punch consisting of a base, a paper clip, and a paper punch built into the paper clip. A "U" shaped steel spring is inserted into depressions in the base and held in place with projections formed in the base and a depression formed in the unit.

3 Claims, 2 Drawing Sheets

CLIPBOARD WITH HOLE PUNCH

BACKGROUND OF THE INVENTION

1. Field of the Invention

This invention relates generally to a clipboard and more specifically to a desk piece paper holder and a paper punch.

2. Discussion of the Prior Art

There are numerous products on the market for keeping papers attached to a backing board to be used as a portable note pad with removable sheets. One such clipboard consists of a pair of opposed metal parts including a base and a clip pivoted together and held in a closed position with a wire spring. The spring loaded clip is then fastened to the board with screws or rivets. When holes are needed in the paper, a separate paper punch must be located, the paper punched, and then filed.

SUMMARY OF THE INVENTION

The present invention provides a more efficient and convenient device for holding paper and punching holes for permanent filing. The invention comprises two basic parts, a base and a clip pivotally opposed to each other at two hinge points. Two "U" shaped steel springs are mounted in recesses in the base, each recess having a slightly raised mounting pin to fit within a hole formed in the spring to hold the spring in position without a permanent fastening. A mounting hole may be formed in the base for mounting the invention on a hanging hook or nail. The clip is formed with a recess at one edge and angled drawer brackets are formed on the underside to guide and hold a paper collecting chamber in a position beneath paper hole punch openings to collect paper as it is punched through by the two paper punches. A paper collecting chamber is formed as a narrow drawer sliding within the angled drawer brackets. The paper collecting chamber is held in position by a small raised area which locks on a drawer bracket nearest the recess.

DESCRIPTION OF THE PREFERRED EMBODIMENT

Figure 1:
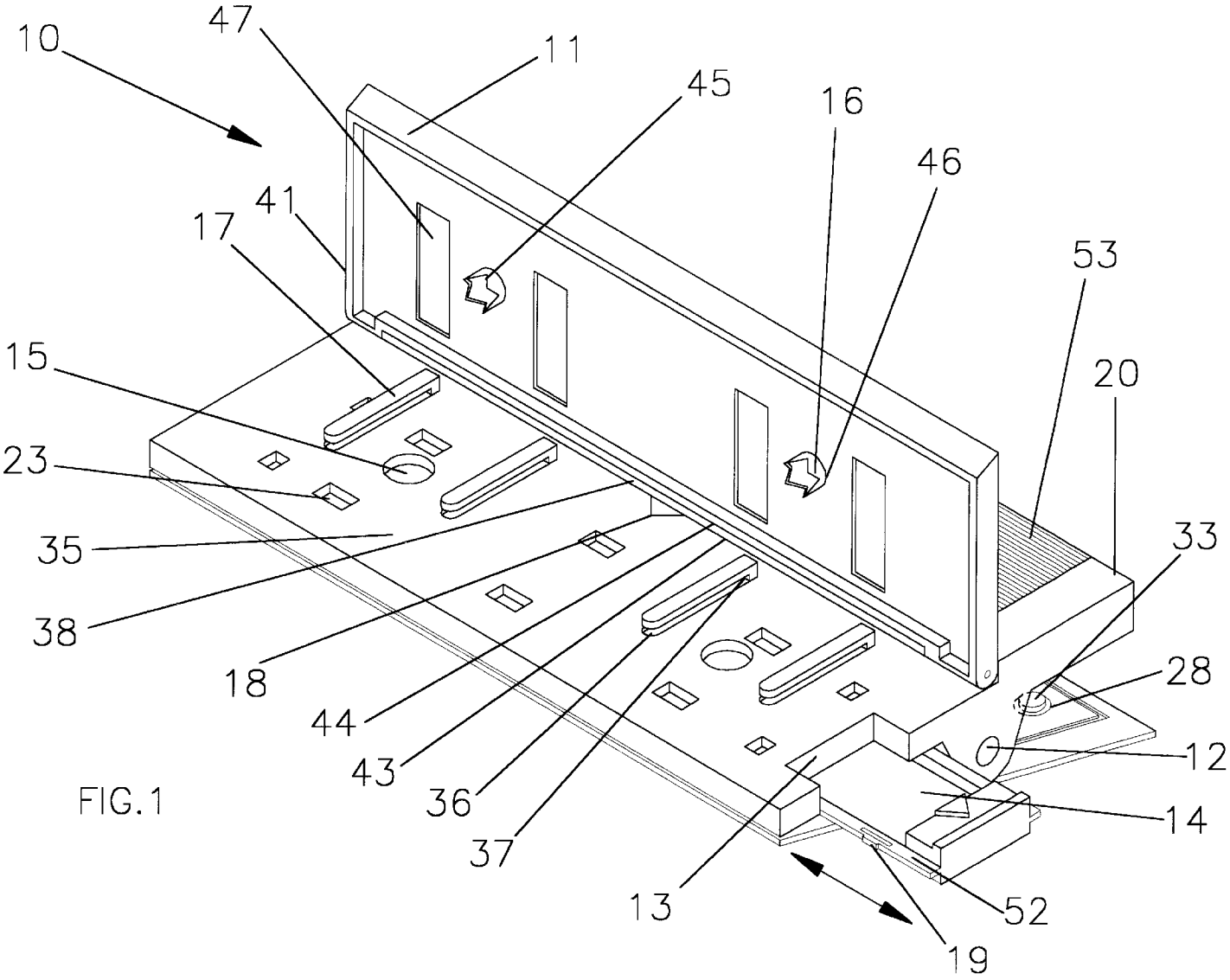
FIG. 1 is a top perspective view of the clipboard with hole punch in accordance with the invention.
Figure 2:
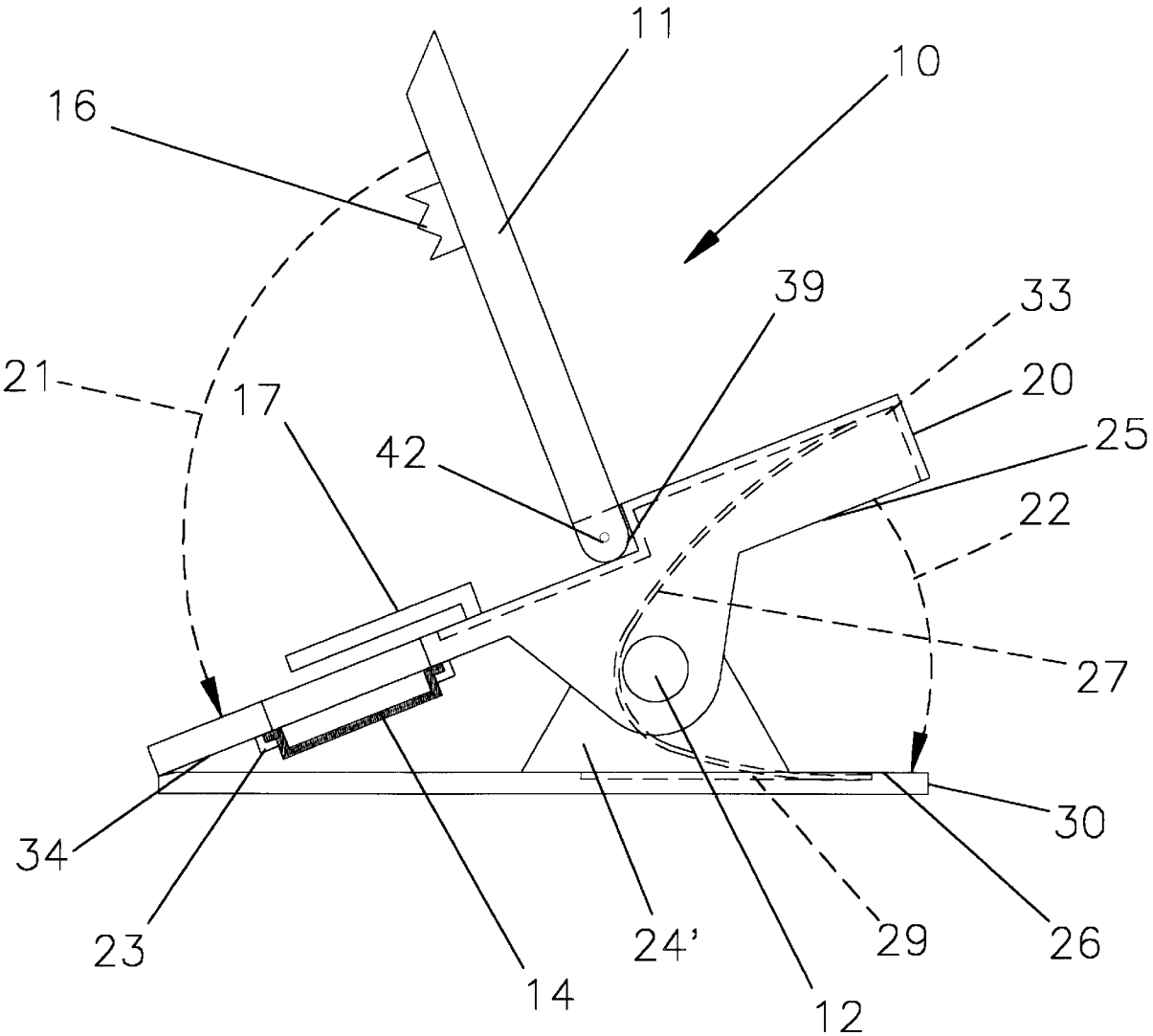
FIG. 2 is an end view of the clipboard with hole punch in accordance with the invention.

The paper holder/paper punch of the invention is indicated generally by the numeral 10 in the top perspective view shown in FIG. 1. The holder/punch 10 may be made from a high impact, injection-molded plastic. This material is durable, lightweight, has high tensile strength, and is relatively inexpensive. The two parts forming the paper clip portion of the invention are the paper clip 20 and the opposed part, base 30 which are pivotally connected with hinge 12 at the hinge protrusions 24 and 24'. Protrusions 24 are formed along the bottom outer edge surface 25 of paper clip 20. Protrusions 24' are formed projecting upwardly from upper surface 26 of base 30. Protrusions 24' are formed a short distance away from the outer edge of base 30 and when pivotally connected with hinges 12, are located within the space between protrusions 24 of paper clip 20. The hinges 12 may be aluminum or steel, hollow rivets which are peened after assembly, to hold the two parts, paper clip 20 and base 30 pivotally joined. The holder/punch 10 opening action is denoted by the numeral 22.

Two "U" shaped steel, flat springs 27 are inserted between the clip 20 and the base 30 to provide the gripping force between the clip 20 and the base 30. Each of the springs 27 are formed from a rectangular sheet of steel, bent in the form of a "U", and a single hole 28 is formed at one end of each of the springs 27. The base 30 contains two depressions 29 formed in the inner surface and a round projection 32 formed in each depression. Paper clip 20 is also formed with a depression 33 which forms a seat for the blank end of springs 27 when inserted between the two parts, and into the depressions 29 and 33 of clip 20 and base 30. The springs 27 are inserted between the paper clip 20 and the base 30 with the flat surfaces pressing against the surface of the depressions 29 and 33 and the holes 28 are mated with the round projections 32 to lock the springs 27 in place without a permanent fastening. Grooves 53 are provided on the top surface of paper clip 20 to provide friction when pressure is applied to open the paper clip 20 to insert paper.

A keyhole shaped mounting hole (not shown) may be formed in the base 30 for mounting the clip/punch 10 on a hanging hook or nail.

Paper clip 20 is formed with a recess 13 at a first edge and angled drawer brackets 23 are formed on the underside 34 to guide and hold paper collecting chamber drawer 14 located beneath paper hole punch openings 15 to collect paper as it is punched through by paper punches 16. Angle brackets 23 are also visible from the top side 35 of paper clip 20. Paper stops/guides 17 are formed in the top side 35 of paper clip 20. The center of the hole punch openings 15 is indicated by the arrow shaped projection 18. In practice, a sheet of paper (not shown) is slid into the gaps 36 and slid forward until the edge of the paper reaches the stop 37 where it is held in position for punching. Notches 39 are formed in each end of top surface 40.

The paper punch 11 is formed with a hinge portion 41 on each end. The hinge portions 41 are inserted within the notches 39 formed in top surface 40 and the paper punch 11 is pivotally fastened to the mounting portion 43 of the paper clip 20 with a hinge pin 42. Edge surface 44 of paper punch 11 is slightly curved and forms an interference fit with projection 38. As the paper punch 11 is opened to permit insertion of a sheet of paper, the slight interference fit resists the opening action to a point where the edge surface 44 overcomes the interference and snaps into an open position. The interference fit then retains the paper punch in an open position until manually reset to the closed position. The interference fit also serves to keep the paper punch 11 in a down position when not in use. Metal, paper punches 16 are formed with a plurality of "V" shaped notches 45 which are used for cutting the paper as the punch 11 is depressed. The punches 16 are mounted in projections 46 either by molding or heat sealing.

Depressions 47 are formed on the bottom surface 48 directly opposite to the paper stop/guides 17 to permit clearance above the stop/guides 17 when the paper punch 11 is operated.

Paper collecting chamber, drawer 14, is formed as a narrow, shallow drawer, which is adapted to slide within the angled drawer brackets 23. Drawer end 49 is formed with a depression 50 having a direction arrow 51 formed thereon. The depression 50 is provided as a convenient finger grip used to pull the drawer 14 out of its collecting position to an unloading position. Drawer 14 also has a drawer stop 19 formed on a first side, in a position which may engage a first drawer bracket 23 when the drawer 14 is closed. The drawer stop 19 consists of a slight projection and a slot on the outer edge of drawer slide 52.

While the invention has been explained with respect to a preferred embodiment thereof, it is contemplated that various changes may be made in the invention without departing from the spirit and scope thereof.

What is claimed is:

1. The combination of a paper holder and a paper punch said combination comprising:

a base consisting of a high impact, injection molded plastic, said base having a top surface, said top surface having a pair of depressions formed therein, a pair of hinge protrusions extending upwardly and a round projection formed in each of said depressions, a paper clip consisting of a high impact, injection molded plastic, said clip having a bottom outer edge surface, a top side, a first end and a second end, said underside having a plurality of paper stop/guides formed thereon, and a pair of hole punch openings formed therein, said underside having a plurality of drawer brackets formed thereon near said first end, a pair of hinge protrusions formed thereon, a mounting portion, and a depression formed near said second end, said top side having a pair of notches formed therein and a projection formed between said notches, said base and said paper clip being pivotally joined together with said hinge protrusions, a paper punch consisting of a high impact, injection molded plastic, said paper punch having a bottom surface, an edge surface, a pair of hinge portions and a pair of paper punches fastened to said bottom surface, said paper punch hinge portions being pivotally joined together with said paper clip mounting portion, a paper collecting chamber drawer slideably inserted within said drawer brackets, and a pair of "U" shaped, flat springs inserted between said base and said paper clip, each of said springs having a first end, and a second end, a hole formed at each of said first ends, said first ends being inserted within said pair of base depressions and said holes being mated with said base round projections, said second end being inserted within said paper clip depression formed near said second end.

2. The combination of a paper holder and a paper punch as claimed in claim 1 wherein said paper punch edge surface is curved to provide an interference fit with said paper punch projection.

3. The combination of a paper holder and a paper punch as claimed in claim 1 wherein said paper collecting chamber drawer consists of a shallow chamber, a drawer stop formed on a first side in a position to engage a first of said drawer brackets and a depression having a direction arrow formed thereon.

* * * * *